US009618890B2

(12) United States Patent
Kondo

(10) Patent No.: US 9,618,890 B2
(45) Date of Patent: Apr. 11, 2017

(54) FIXING DEVICE AND IMAGE FORMING APPARATUS

(71) Applicant: KYOCERA Document Solutions Inc., Osaka (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/972,591

(22) Filed: Dec. 17, 2015

(65) Prior Publication Data

US 2016/0209791 A1 Jul. 21, 2016

(30) Foreign Application Priority Data

Jan. 16, 2015 (JP) ..... 2015-006346

(51) Int. Cl.
*G03G 15/20* (2006.01)

(52) U.S. Cl.
CPC ..... *G03G 15/2085* (2013.01); *G03G 15/2028* (2013.01); *G03G 15/2032* (2013.01); *G03G 15/2067* (2013.01)

(58) Field of Classification Search
CPC ..... G03G 15/2028; G03G 15/2085
See application file for complete search history.

(56) References Cited

U.S. PATENT DOCUMENTS 9,389,556 B1 * 7/2016 Kitagawa ..... G03G 15/2032
2007/0025750 A1 * 2/2007 Ando ..... G03G 15/2039 399/67
2010/0232848 A1 * 9/2010 Naitoh ..... G03G 15/2028 399/323
2011/0217096 A1 * 9/2011 Kikuchi ..... G03G 15/20 399/329
2011/0229236 A1 * 9/2011 Ehara ..... G03G 15/205 399/400
2012/0177419 A1 * 7/2012 Kikuchi ..... G03G 15/2053 399/329
2012/0273478 A1 * 11/2012 Saito ..... G03G 15/2067 219/469

FOREIGN PATENT DOCUMENTS

JP 2001-091221 A 4/2001
JP 2010-091595 A 4/2010

* cited by examiner

*Primary Examiner* — David M Gray
*Assistant Examiner* — Carla Therrien
(74) *Attorney, Agent, or Firm* — Studebaker & Brackett PC

(57) ABSTRACT

A fixing device includes a fixing member, a pressure member, a separation member and a separation/contact mechanism. The fixing member and the pressure member are provided so as to separate away from or come in contact with each other and to form a fixing nip. The fixing member has a flexibility and is deformable by separating away from or coming in contact with the pressure member. The separation member is disposed to face the fixing member and configured to separate a sheet passed through the fixing nip from the fixing member. The separation/contact mechanism is configured to support the separation member such that a fixing member side edge portion of the separation member is deformed along the fixing member in synchronization with the separating and contacting of the fixing member and the pressure member.

8 Claims, 9 Drawing Sheets

FIXING DEVICE AND IMAGE FORMING APPARATUS

INCORPORATION BY REFERENCE

This application is based on and claims the benefit of priority from Japanese Patent application No. 2015-006346 filed on Jan. 16, 2015, the entire contents of which are incorporated herein by reference.

BACKGROUND

The present disclosure relates to a fixing device configured to fix a toner image onto a recording medium and to an image forming apparatus including the fixing device.

An electro-photographic image forming apparatus, such as a printer, a copier, a facsimile and a multifunction peripheral, is provided with a fixing device configured to fix a toner image onto a recording medium, such as a sheet of paper. The fixing device fixes the toner image on the sheet by passing the sheet through a fixing nip formed between a fixing member and a pressure member which come in pressure contact with each other.

Such fixing device constructed as described above is provided with a separation member on a downstream side of the fixing nip in a sheet conveying direction in order to prevent the sheet from wrapping around the fixing member after passing through the fixing nip and to steadily separate the sheet from the fixing member. The separation member is often provided so as to keep a predetermined gap from the fixing member in order to avoid the fixing member from being damaged and the separation member from affecting the toner image fixed on the sheet.

Still further, there is a case where the fixing apparatus is configured to adjust a pressure (fixing pressure) between the fixing member and the pressure member at the fixing nip by bringing the pressure member close to or apart from the fixing member in consideration of durability of the fixing member, applicability to various sheets (plain sheet, thick sheet, envelope and the like), resolution of a document or the like. In a case of a thick recording medium such as an envelope for example, the fixing pressure is set to be lower than that of a plain sheet.

When the fixing pressure increases, if a thin cylindrical fixing roller is used as the fixing member, there is a case where the fixing roller is pressed inside and then deflects. Here, in a case when the separation member is positioned such that a gap between the separation member and the fixing roller has a predetermined value in a state in which the fixing pressure is low, i.e., in a state in which the deflection of the fixing roller is small, if the deflection of the fixing roller increases, there arises a problem that the sheet cannot be adequately separated by the separation member because the gap between the fixing roller and the separation member increases. The gap between the fixing roller and the separation member becomes wide at a center portion of the fixing roller in particular. Meanwhile, if the separation member is positioned such that the gap between the separation member and the fixing roller has a predetermined value in a state in which the fixing pressure is high, i.e., in a state in which the deflection of the fixing roller is large, if the deflection of the fixing roller is small, there is a case where the separation member comes into contact with the fixing roller, thus damaging the fixing roller.

Then, there is proposed a fixing device configured to support a sheet-like separation member by supporting members provided at predetermined intervals in a width direction of the sheet. This fixing device is configured to prevent the separation member from interfering with the fixing member by separating the pressure member from the fixing member and also separating the separation member from the fixing member by manipulating a handle at a jammed sheet processing. There is also proposed a fixing device in which a center portion of the separation member is curved into an arc shape protruding toward a sheet conveying direction in consideration that the gap between the fixing member and the separation member varies if the separation member is thermally deformed.

When it is required to lower a conveying speed, for example, when an image of high resolution of 1200 dpi is outputted to a plain sheet, because there a passing period of the sheet through the fixing nip is prolonged and the sheet may receive an excessive amount of heat, there is a demand to feed a sheet through the fixing nip under a low fixing pressure. However, if the separation member is positioned based on the state in which the pressure member is in pressure contact with the fixing member as described above fixing devices, it is unable to accommodate to such requirement and to adjust the fixing pressure suitable for thickness of the sheets.

SUMMARY

In accordance with an embodiment of the present disclosure, a fixing device includes a fixing member, a pressure member, a separation member and a separation/contact mechanism. The a fixing member and the pressure member are provided so as to separate away from or come in contact with each other and to form a fixing nip. The fixing member has a flexibility and is deformable by separating away from or coming in contact with the pressure member. The separation member is disposed to face the fixing member and configured to separate a sheet passed through the fixing nip from the fixing member. The separation/contact mechanism is configured to support the separation member such that a fixing member side edge portion of the separation member is deformed along the fixing member in synchronization with the separating and contacting of the fixing member and the pressure member.

In accordance with an embodiment of the present invention, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a fixing device and an image forming apparatus according to an embodiment of the present disclosure will be described.

Figure 1:
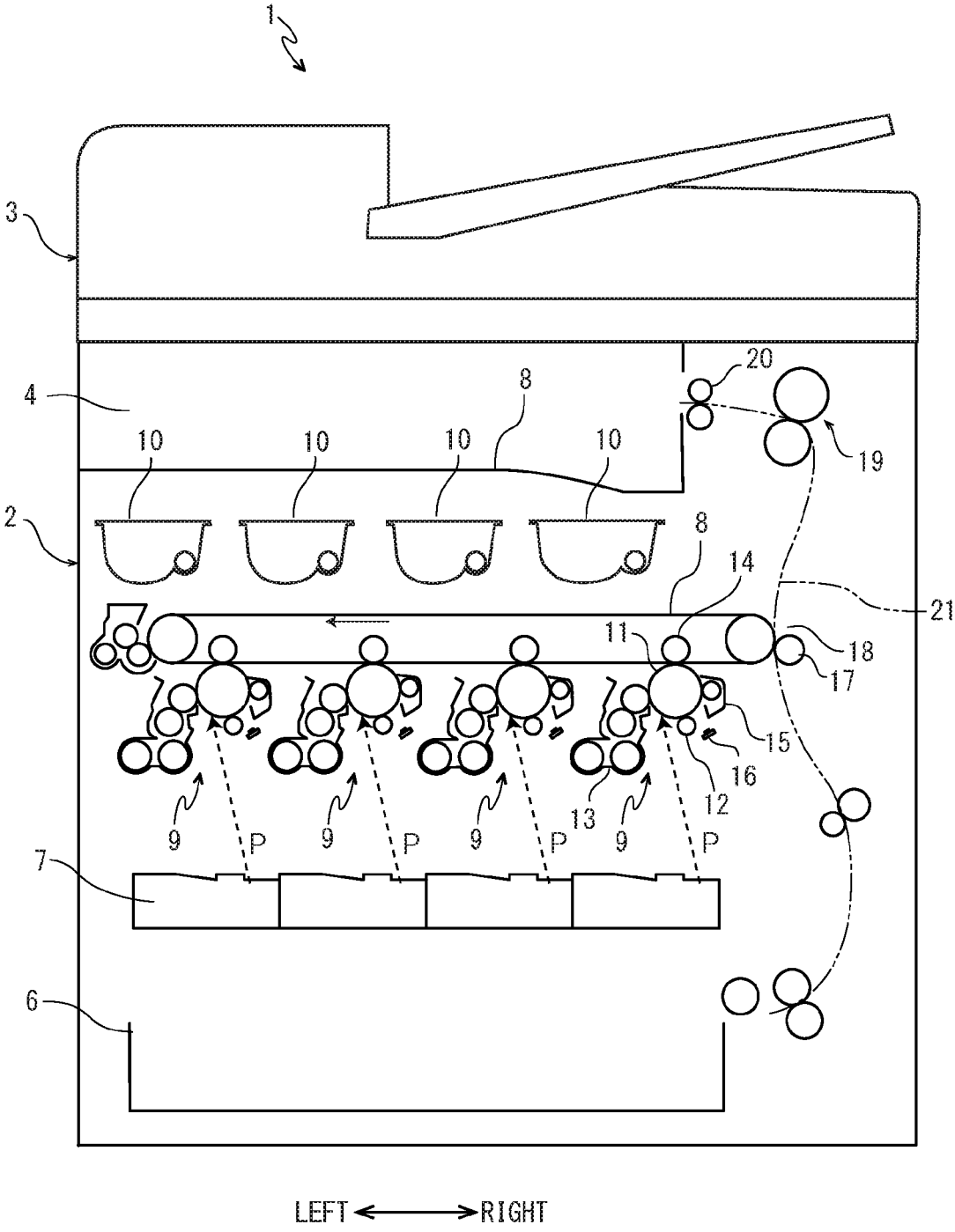
FIG. 1 is a schematic diagram showing a configuration of a color MFP according to a first embodiment of the present disclosure.

First, with reference to FIG. 1, the entire structure of a color MFP (Multifunction Peripheral) as an image forming apparatus will be described. FIG. 1 is a schematic diagram schematically showing the color MFP according to an embodiment of the present disclosure. In the following description, a front side of the sheet plane of FIG. 1 shows a front side of the color MFP and left and right directions are based on a direction viewed from the front side of the color MFP 1.

As shown in FIG. 1, the color MFP 1 includes an image forming part 2 and an image reading part 3 arranged above the image forming part 2.

The image forming part 2 is formed with an in-body sheet ejecting space 4 opened to a front side and a left side under the image reading part 3. Under the in-body sheet ejecting space 4, an ejected sheet tray 5 is provided on an upper face of the image forming part 2. The image forming part 2 has a sheet feeding cassette 6 and an exposure device 7 containing a laser scanning unit (LSU) above the sheet feeding cassette 6. Above the exposure device 7, an intermediate transferring belt 8 is bridged between rollers. Along the lower portion of the intermediate transferring belt 8, four image forming units 9 are arranged side by side. Under the ejected sheet tray 5, toner containers 10 storing toner of each of 4 colors are attached.

The image forming unit 9 has a photosensitive drum 11, as an image carrier, rotatably provided and around the photosensitive drum 11, a charger 12, a development device 13, a transferring roller 14 which forms a first transferring part with the intermediate transferring belt 8, a cleaning device 15 and a static eliminator 16 are arranged along a rotating direction of the photosensitive drum 11.

On a right side of the intermediate transferring belt 8, a transferring roller 17 is arranged. Between the intermediate transferring belt 8 and the transferring roller 17, a second transferring part 18 is formed. Above the second transferring part 18, a fixing device 19 is provided and above the fixing device 19, a sheet ejecting device 20 facing the ejected sheet tray 5 is provided. Furthermore, a sheet conveying path 21 is formed from the sheet feeding cassette 6 to the sheet ejecting device 20 through the second transferring part 18 and the fixing device 19.

Next, the operation of forming an image by the color MFP 1 having such a configuration will be described. In each image forming unit 9, after the surface of the photosensitive drum 11 is charged by the charger 12, the exposure device 7 exposes the surface of the photosensitive drum 11 with a laser light (refer to an arrow P in FIG. 1) to form an electrostatic latent image corresponding to the image data read by the image reading part 3 on the surface of the photosensitive drum 11. The electrostatic latent image is then developed into a toner image of corresponding color by the development device 13 with the toner supplied from the corresponding toner container 10. The toner image is first-transferred on the intermediate transferring belt 8 by the transferring roller 14. The above-mentioned operation is repeated in order by the image forming units 9, thereby forming a full color toner image onto the intermediate transferring belt 8. Incidentally, toner and residual electric charge remained on the photosensitive drum 11 is removed by the cleaning device 15 and the static eliminator 16, respectively.

On the other hand, the sheet fed from the sheet feeding cassette 6 is conveyed to the second transferring part 18 along the sheet conveying path 21 in a suitable timing for the above-mentioned image forming operation. Then, in the second transferring part 18, the full color toner image on the intermediate transferring belt 8 is second-transferred onto the sheet. The sheet with the second-transferred toner image is conveyed to a downstream side along the sheet conveying path 21 to enter the fixing device 19, and then, the toner image is fixed on the sheet in the fixing device 19. The sheet with the fixed toner image is ejected from the sheet ejecting device 20 onto the ejected sheet tray 5.

Figure 2:
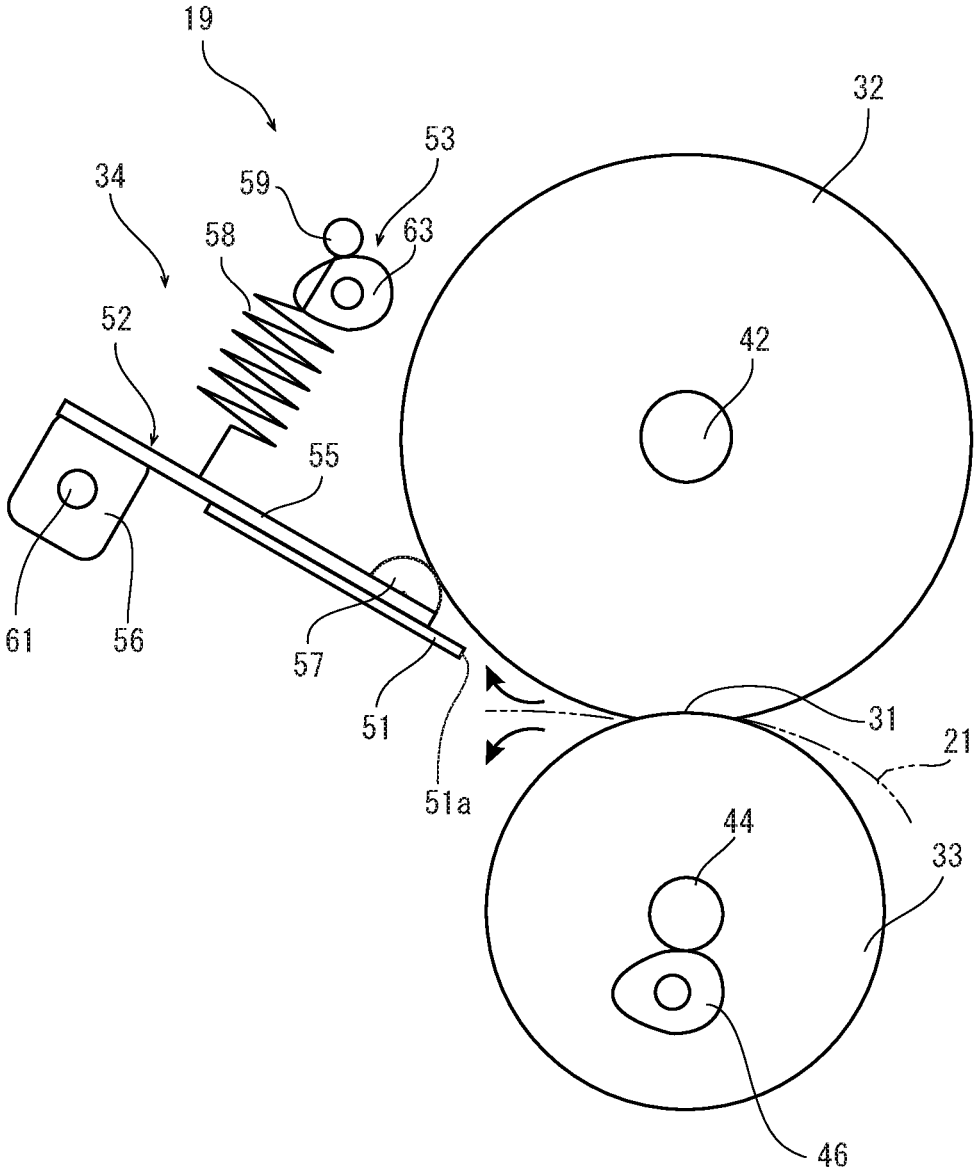
FIG. 2 is a side view showing a fixing device at a low fixing pressure, according to a first embodiment of the present disclosure.
Figure 3:
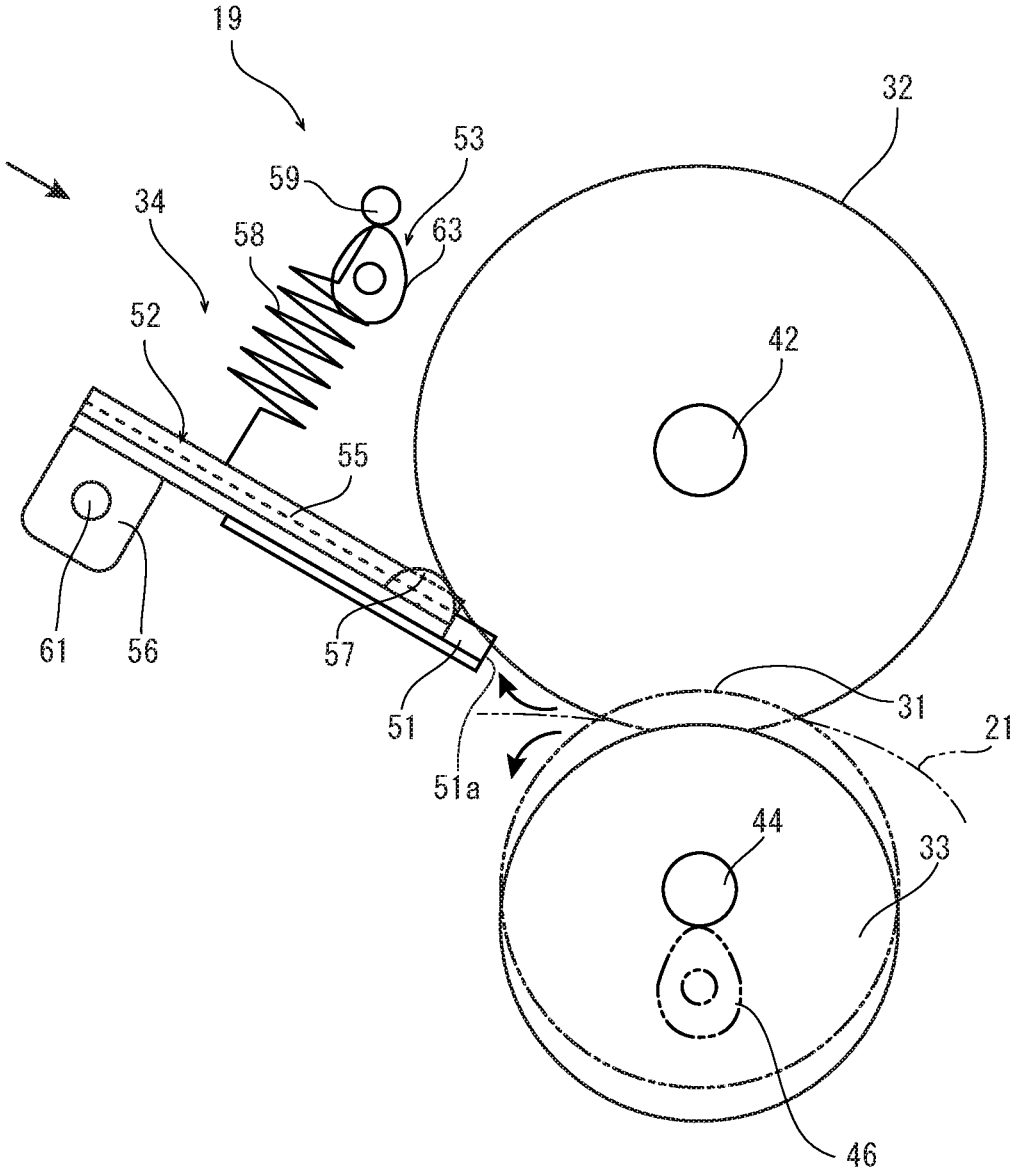
FIG. 3 is a side view showing the fixing device at a high fixing pressure, according to the first embodiment of the present disclosure.
Figure 4:
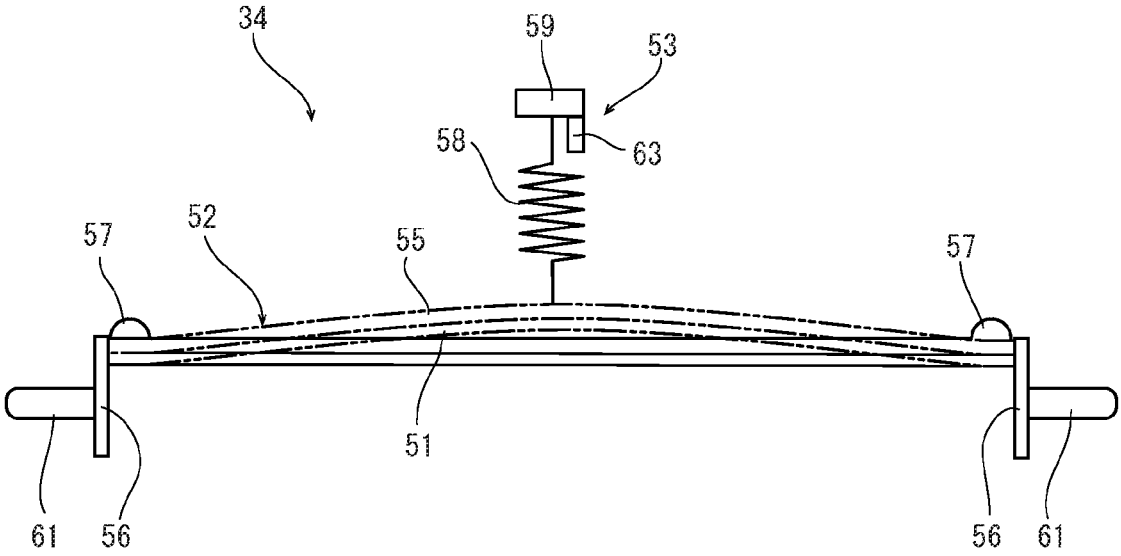
FIG. 4 is a schematic diagram showing a separation member viewed from a direction of an arrow in FIG. 3, in the fixing device according to the first embodiment of the present disclosure.
Figure 5:
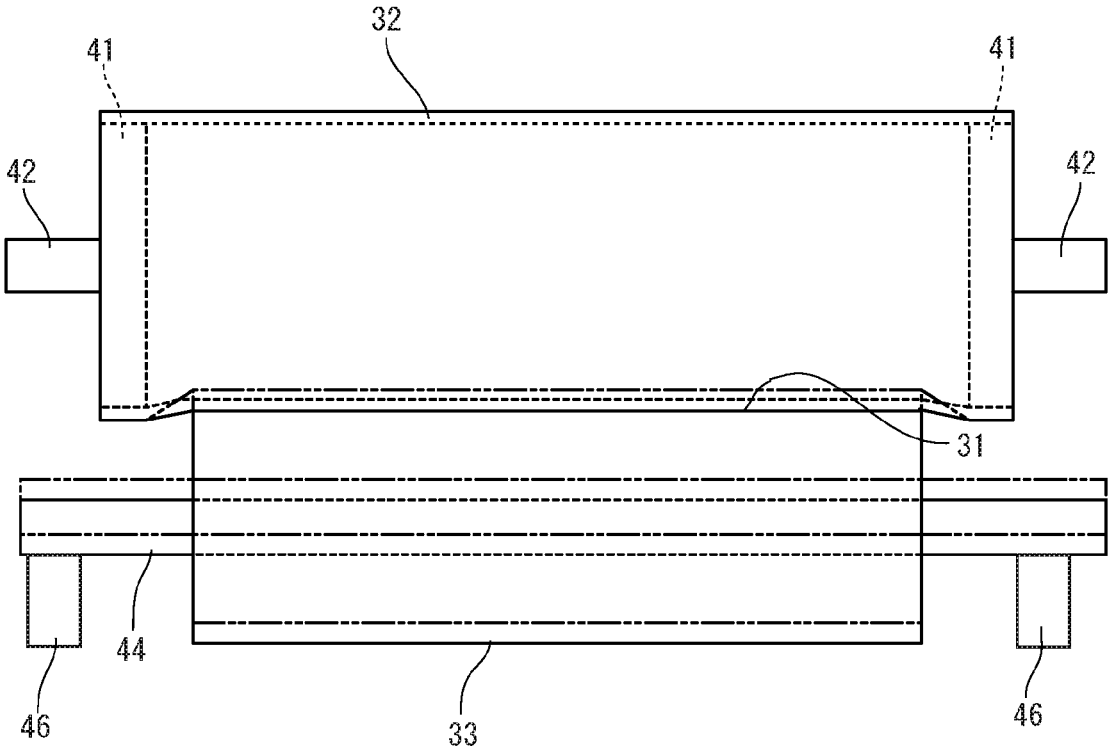
FIG. 5 is a side view showing a fixing roller and a pressure roller of the fixing device according to the first embodiment of the present disclosure.

Next, the fixing device 19 according to the first embodiment will be described with reference to FIGS. 2 through 5. FIG. 2 is a front view showing the fixing device in a low fixing pressure, FIG. 3 is a front view showing the fixing device in a high fixing pressure, FIG. 4 is a side view showing a separation mechanism viewed from a direction of an arrow in FIG. 3 and FIG. 5 is a side view showing a fixing roller and a pressure roller of the fixing device.

The fixing device 19 includes a fixing roller 32 (fixing member), a pressure roller 33 (pressure member) which comes in pressure contact with the fixing roller 32 to form a fixing nip 31 with the fixing roller 32 and a separation mechanism 34 configured to separate the sheet passed through the fixing nip 31 from the fixing roller 32. The fixing roller 32, the pressure roller 33 and the separation mechanism 34 are supported by a fixing frame (not shown).

The fixing roller 32 is formed into a thin cylindrical shape elongated in the front-rear direction and has a flexibility deformable when it is pressed. The fixing roller 32 is made of a base layer, an elastic layer provided around the base layer and a releasing layer coating the elastic layer. The base layer is made of a metal material, such as SUS, and a resin material, such as PI, i.e., polyimide. The elastic layer is made of silicon rubber, for example, and the releasing layer is made of a PFA (tetrafluoroethylene-perfluoroalkyl vinyl ether copolymer) tube.

The both side end portions on outside of a sheet passing area of the fixing roller 32 are supported by disk-like supporting disks 41. The supporting disks 41 are formed with supporting shafts 42 extending in the front-rear direction. The supporting shafts 42 is supported to the fixing frame. The fixing roller 32 rotates along an outer circumferential surface of the support disks 41 around the supporting shafts 42. Still further, the fixing roller 32 is heated by a heat source (not shown) disposed within the fixing roller 32.

The pressure roller 33 is formed into a substantially columnar shape elongated in the front-rear direction and has a supporting shaft 44. An elastic layer is provided around the supporting shaft 44 and the elastic layer is coated by a releasing layer. The elastic layer is made of silicon rubber for example, and the releasing layer is made of a PFA tube.

The pressure roller 33 is supported under the fixing roller 32 rotatably in a counterclockwise direction in FIG. 2 around the supporting shaft 44. The pressure roller 33 is brought into pressure contact with the fixing roller 32, and the fixing roller 32 rotates following the rotation of the pressure roller 33 in an opposite direction from the rotation direction of the pressure roller 33.

Still further, the pressure roller 33 is supported so as to separate away from or come in contact with the fixing roller 32 by a separation/contact mechanism. When the pressure roller 33 is moved in a direction away from the fixing roller 32 by the separation/contact mechanism, the fixing pressure at the fixing nip 31 becomes low, thus decreasing a deflection amount of the fixing roller 32 as shown by a solid line in FIGS. 2 and 5. On the other hand, when the pressure roller 33 is moved in a direction closer to the fixing roller 32, the fixing pressure at the fixing nip 31 becomes high, thus increasing the deflection amount of the fixing roller 32 as shown by a two-dot chain line in FIGS. 3 and 5. As the separation/contact mechanism of the pressure roller 33, a mechanism configured to press the supporting shaft 44 by using a cam 46 is applicable, for example.

As shown in FIGS. 2 through 4, the separation mechanism 34 includes a rectangular separation plate 51 (separation member) elongated in the front-rear direction, a supporting member 52 configured to support the separation plate 51 and a separation/contact mechanism 53 configured to bring the supporting member 52 away from or close to the fixing roller 32. The separation mechanism 34 is disposed facing the fixing roller 32 on a downstream side in the sheet conveying direction from the fixing nip 31.

The separation plate 51 is made of a flexible thin plate-like conductive member (for example, a sheet metal such as SUS) and has an edge portion 51*a* on a side of the fixing roller 32. The fixing roller side edge portion 51*a* is formed linear in parallel with the supporting shaft 42 of the fixing roller 32.

The supporting member 52 includes a rectangular base part 55 elongated in the front-rear direction and supporting shaft parts 56 provided at both side ends in the front-rear direction of the base part 55. On a lower surface of the base part 55, the separation plate 51 is supported. The separation plate 51 is positioned such that the fixing roller side edge portion 51*a* projects from an edge portion of the base part 55 on a side of the fixing roller 32. Further, semi-spherical separators 57 protruding upward are formed at front and back corners on an upper surface of the base part 55. Each separator 57 corresponds to each supporting disk 41 of the fixing roller 32. Still further, one end of a coil spring 58 is connected to near a center of the upper surface of the base part 55 in the front-rear direction. A columnar movable shaft 59 elongated in the front-rear direction is provided at another end of the coil spring 58.

The supporting shaft parts 56 are formed extending downward from side edges in the front-rear direction of the base part 55. The supporting shaft parts 56 are provided with supporting shafts 61 projecting coaxially and outwardly in the front-rear direction.

The supporting member 52 is supported by the fixing frame swingable around the supporting shaft 61 with the separation plate 51 facing the fixing roller 32 from a counter direction to the rotation direction of the fixing roller 32.

The separation/contact mechanism 53 has a cam 63 provided so as to press the movable shaft 59 provided at another end of the coil spring 58. The rotation of the cam 63 moves the movable shaft 59 so as to move the base part 55 of the supporting member 52 close to or away from the fixing roller 32 through the coil spring 58. That is, the separation plate 51 supported to the supporting member 52 is supported such that although the both side edge portion in the front-rear direction is kept contacting with the supporting disk 41 by the separators 57, the center portion in the front-rear direction is deformable so as to be close to the fixing roller 32.

Further, the separation/contact mechanism 53 is provided to be synchronized with the separation/contact mechanism of the pressure roller 33. That is, if the separation/contact mechanism of the pressure roller 33 is actuated in a direction in which the fixing pressure at the fixing nip 31 becomes large, the separation/contact mechanism 53 of the separation mechanism 34 deforms the separation plate 51 in a direction close to the fixing roller 32 as indicated by two-dot chains in FIGS. 3 and 4. It is noted that although the FIG. 3 is shown as if the separation plate 51 and the supporting member 52 partially interfere with the fixing roller 32, actually they do not interfere with the fixing roller 32 because the fixing roller 32 is deformed inward.

On the other hand, if the separation/contact mechanism of the pressure roller 33 is actuated in a direction in which the fixing pressure at the fixing nip 31 becomes low, the separation plate 51 returns to its original plate shape as indicated by the two-dot chain line in FIGS. 2 and 4. The mechanism configured to synchronize the separation/contact mechanism of the pressure roller 33 with the separation/contact mechanism 53 may be realized by controlling the actuations of the both separation/contact mechanisms with a control part (not shown) or by mechanically interlocking the cams 46 and 63 of the both separation/contact mechanisms. It is noted that the synchronization here includes that the separation/contact mechanism 53 is actuated so as to be shifted by a time during which the fixing roller 32 rotates from the fixing nip 31 to a position facing the separation mechanism 34.

The separation mechanism 34 is set such that the fixing roller side edge portion 51*a* of the separation plate 51 faces the surface of the fixing roller 32 through a predetermined gap in a state in which the fixing roller 32 is separated mostly away from the pressure roller 33 and the fixing pressure of the fixing nip 31 is lowest.

In the fixing device 19 constructed as described above, in the state in which the fixing pressure of the fixing nip 31 is lowest, the separation mechanism 34 is set such that the separators 57 come in contact with the supporting disks 41 of the fixing roller 32 and the fixing roller side edge portion 51*a* of the separation plate 51 is supported so as to keep the predetermined gap away from the fixing roller 32 along the length direction of the fixing roller 32. When the sheet passes through the fixing nip 31 in this state, the sheet is separated from the fixing roller 32 by the separation plate 51 of the separation mechanism 34.

When the fixing pressure of the fixing nip 31 increases, the separation/contact mechanism of the pressure roller 33 is actuated to bring the pressure roller 33 closer to the fixing roller 32. Then, an inner portion inside of the side end portions of the fixing roller 32 is pressed by the pressure roller 33 to be deformed inward. Then, the fixing roller 32 is passed through the fixing nip 31 with the inner portion deformed inward. In the separation mechanism 34, the separation/contact mechanism 53 is actuated in synchronization with the separation/contact mechanism of the pressure roller 33, and the separation plate 51 is deformed in a direction in which the center portion thereof is close to the fixing roller 32, i.e., in a direction in which the center portion thereof runs along the surface of the inward deformed fixing roller 32. Thereby, the gap between the fixing roller 32 and the separation plate 51 becomes uniform in the front-rear direction, and the separation plate 51 separates the sheet from the inward deformed fixing roller 32.

As described above, according to the fixing device 19 of the present disclosure, even if the fixing roller 32 is deformed inward by the change in the fixing pressure at the fixing nip 31, because the separation plate 51 is curved following the deformation of the fixing roller 32 to keep the gap between the fixing roller 32 and the separation plate 51 constant, it is possible to steadily separate the sheet.

Still further, because the center portion of the fixing roller 32 is deformed inward as shown in FIG. 5, by pulling the center portion of the separation plate 51 with the coil spring 58, it is possible to bring the separation plate 51 closer to the center portion of the fixing roller 32 and to steadily separate the sheet.

Still further, because the separation plate 51 is positioned with respect to the fixing roller 32 while keeping the predetermined gap in the state in which the fixing pressure of the fixing nip 31 is low, i.e., in the state in which the inward deformation of the fixing roller 32 is smallest, the fixing roller 32 does not interfere with the separation plate 51 and therefore it is possible to prevent the fixing roller 32 from being damaged.

Figure 6:
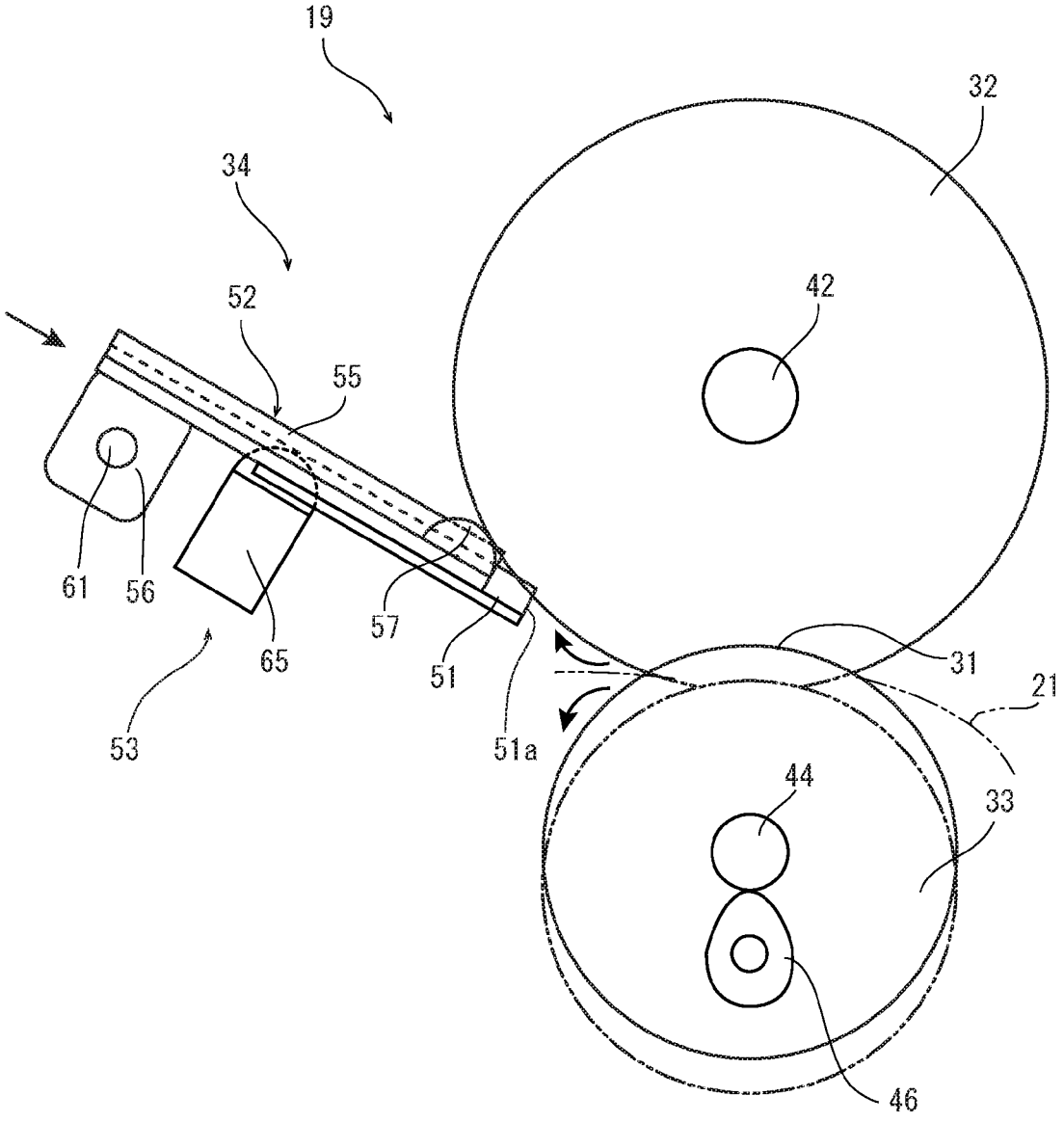
FIG. 6 is a side view showing a fixing device at a low fixing pressure, according to a second embodiment of the present disclosure.
Figure 7:
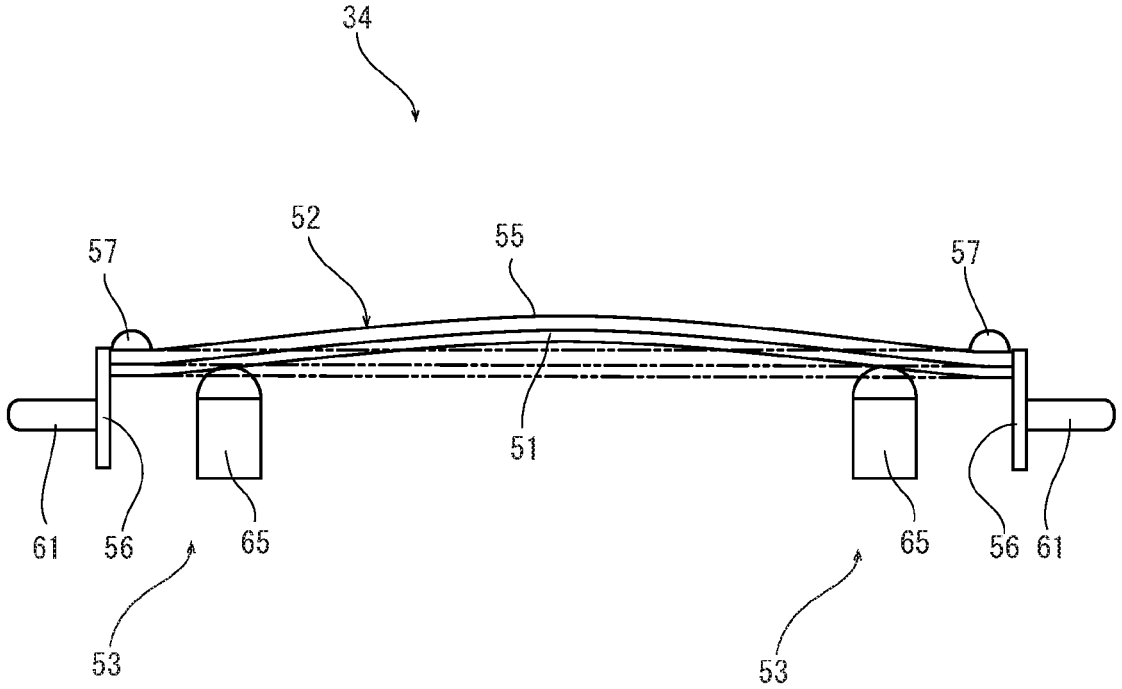
FIG. 7 is a side view showing the fixing device at a high fixing pressure, according to the second embodiment of the present disclosure.

Next, a separation/contact mechanism in a fixing device of a second embodiment will be described with reference to FIGS. 6 and 7. FIG. 6 is a front view showing the fixing device and FIG. 7 is a side view showing the separation/contact mechanism viewed from a direction of an arrow in FIG. 6.

The separation mechanism 34 includes a pair of pressing members 65 provided under the supporting member 52, as a separation/contact mechanism 53. The pressing members 65 are provided so as to push up both the side end portions in the front-rear direction of the base part 55 of the supporting member 52 from a direction orthogonal to the base part 55. A cam member may be used as a mechanism pushing up the pressing member 65, for example. Still further, the separation/contact mechanism 53 is provided so as to synchronize with the separation/contact mechanism of the pressure roller 33 also in this separation mechanism 34.

When the separation/contact mechanism 53 is actuated so as to advance the pressing members 65 and push up the both side end portions in the front-rear direction of the base part 55, the base part 55 is deformed such that the center portion bends in the push up direction. Thereby, the separation plate 51 bends such that the center portion thereof is close to the fixing roller 32.

In the separation mechanisms 34 of the first and second embodiments, it is possible to stably deform the separation plate 51 by directly pressing or pulling the base part 55 of the supporting member 52 supporting the separation plate 51.

Figure 8:
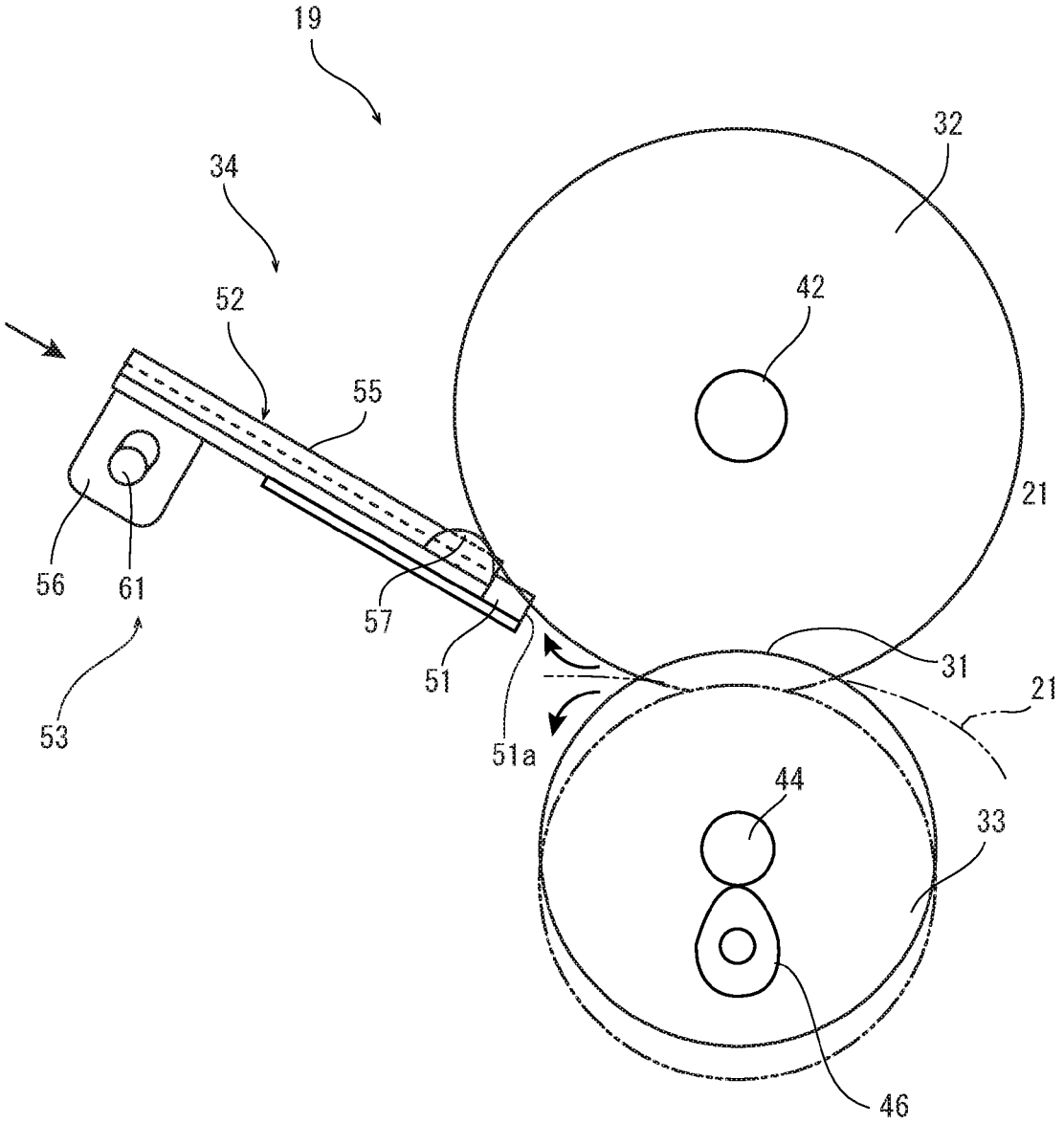
FIG. 8 is a side view showing a fixing device according to a third embodiment of the present disclosure.
Figure 9:
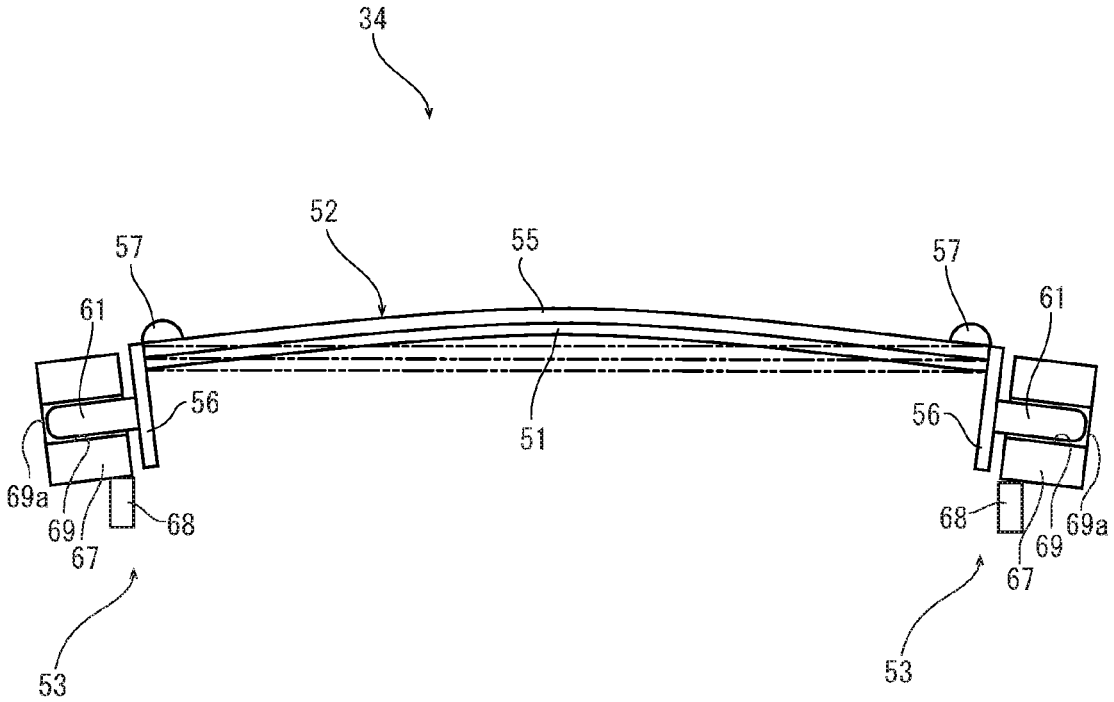
FIG. 9 is a schematic diagram showing a separation member viewed from a direction of an arrow in FIG. 8, in the fixing device according to the third embodiment of the present disclosure.

Next, a separation mechanism in a fixing device of a third embodiment will be described with reference to FIGS. 8 and 9. FIG. 8 is a front view showing the fixing device and FIG. 9 is a side view showing the separation mechanism viewed from a direction of an arrow in FIG. 8.

The separation mechanism 34 includes, as the separation/contact mechanism 53, a bearing 67 configured to support each of the supporting shafts 61 of the supporting shaft parts 56 and a cam 68 configured to tilt the bearing 67 (the bearing 67 is not shown in FIG. 8). The bearing 67 has a supporting hole 69 through which the supporting shaft 61 is inserted. The bearing 67 is supported tiltably around an outside end portion 69*a* of the supporting hole 69. The cams 68 are provided so as to be in contact with inside portions of outer circumferential surfaces of the bearings 67 from an opposite side to the fixing roller 32 and to tilt the bearings 67 around the outside end portions 69*a* of the supporting holes 69 by rotating synchronized with each other.

When each cam 68 presses the inside portion of the outer circumferential surface of the bearing 67, each bearing 67 tilts toward the fixing roller 32 around the outside end portion 69*a* of the supporting hole 69 in synchronization. That is, the supporting shafts 61 supported by the bearings 67 inclines toward the fixing roller 32 and the separation plate 51 bends such that the center portion thereof is deformed protruding toward the fixing roller 32.

In the third embodiment, because it is possible to provide the separation/contact mechanism 53 on the outside of the sheet passing area of the fixing roller 32, the separation/contact mechanism 53 can be disposed so as not to interfere with the sheet being fed.

While the separation mechanism 34 using the separation plate 51 has been described in the embodiments described above, it is also possible to use a plurality of separation craws disposed at predetermined intervals in the length direction of the fixing roller 32. In the case of using the plurality of separation craws, the separation craws are configured so as to advance toward the fixing roller 32 in synchronization with the separation/contact of the fixing roller 32 and the pressure roller 33.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A fixing device comprising:

a fixing member and a pressure member which are provided so as to separate away from or come in contact with each other and to form a fixing nip, the fixing member having a flexibility and deformable by separating away from or coming in contact with the pressure member, a separation member, which is a flexible thin plate, is disposed to face the fixing member along a length direction of the fixing member and is configured to separate a sheet passed through the fixing nip from the fixing member, and a separation/contact mechanism configured to support the separation member such that a fixing member side edge portion of the separation member is deformed along the fixing member in synchronization with the separating and contacting of the fixing member and the pressure member, wherein the separation/contact mechanism deforms the separation member so that a center portion in a length direction of the separation member protrudes toward the fixing member as a fixing pressure in the fixing nip is increased.

2. The fixing device according to claim 1, wherein the separation/contact mechanism supports the separation member so as to keep a predetermined gap from the fixing member in a state in which the fixing member is separated mostly away from the pressure member and to deform the fixing member side edge portion of the separation member close to a surface of the fixing member in synchronization with the separating and contacting of the fixing member and the pressure member.

3. The fixing device according to claim 1, wherein the separation member is made of a conductive member.

4. The fixing device according to claim 1, wherein the separation/contact mechanism includes a supporting member configured to support the separation member so as to face the fixing member through a predetermined gap, wherein the fixing member side edge portion of the separation member is deformed close to a surface of the fixing member by pulling or pressing the supporting member toward the fixing member.

5. The fixing device according to claim 4, wherein the separation/contact mechanism has an elastic member configured to pull a center portion in a length direction of the supporting member toward the fixing member.

6. The fixing device according to claim 4, wherein the separation/contact mechanism has press members configured to press both side end portions in a length direction of the supporting member toward the fixing member.

7. The fixing apparatus according to claim 1, wherein the separation/contact mechanism includes:

a supporting member configured to support the separation member so as to face the fixing member through a predetermined gap, and supporting shafts provided at both side end portions in a length direction of the supporting members and protruding outward, wherein the fixing member side edge portion of the separation member is deformed close to a surface of the fixing member by tilting the supporting shafts around distal end portions of the supporting shafts.

8. An image forming apparatus comprising the fixing device as set forth in claim 1.

* * * * *